US006428376B1

(12) United States Patent
Reeder

(10) Patent No.: US 6,428,376 B1
(45) Date of Patent: Aug. 6, 2002

(54) AQUATIC BODY BOARD

(76) Inventor: Thorpe Reeder, 32802 Valle Rd. #94, San Juan Capistrano, CA (US) 92675

( * ) Notice: Subject to any disclaimer, the term of this patent is extended or adjusted under 35 U.S.C. 154(b) by 0 days.

(21) Appl. No.: 09/838,928

(22) Filed: Apr. 20, 2001

(51) Int. Cl.[7] ..... B63B 1/00
(52) U.S. Cl. ..... 441/65; 441/79
(58) Field of Search ..... 16/430; 441/65, 441/74, 79; 114/144 R

(56) References Cited

U.S. PATENT DOCUMENTS

| | | | | |
|---|---|---|---|---|
| 2,958,875 A | | 11/1960 | McClain | |
| 3,092,857 A | | 6/1963 | Churchman | |
| 4,439,165 A | | 3/1984 | Rothstein | |
| 4,493,665 A | * | 1/1985 | Liddle | 441/79 |
| 4,678,445 A | * | 7/1987 | Monreal | 441/65 |
| 4,708,675 A | * | 11/1987 | Shoeffler et al. | 441/65 |
| 4,929,208 A | | 5/1990 | Corica | |
| 5,247,898 A | * | 9/1993 | Thornlimb | 441/65 |
| 5,588,651 A | * | 12/1996 | Frost | 473/206 |
| 5,603,645 A | * | 2/1997 | Saccomanno | 441/65 |
| 5,970,900 A | * | 10/1999 | Sheldon et al. | 441/65 |

FOREIGN PATENT DOCUMENTS

| | | |
|---|---|---|
| EP | 0 273 989 A1 | 7/1988 |
| WO | WO 84/01756 | 7/1984 |

* cited by examiner

*Primary Examiner*—Stephen Avila

(57) ABSTRACT

A aquatic body board for providing extra control when body surfing. The aquatic body board includes a board with a handle upwardly extended from a top face of the board and positioned towards a front end of the board. The handle comprises a resiliently deformable material to permit resilient squeezing and bending of the handle.

16 Claims, 4 Drawing Sheets

AQUATIC BODY BOARD

BACKGROUND OF THE INVENTION

1. Field of the Invention

The present invention relates to aquatic body boards and more particularly pertains to a new aquatic body board for providing extra control when body surfing.

2. Description of the Prior Art

The use of aquatic body boards is known in the prior art. More specifically, aquatic body boards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,708,675 by Shoeffler et al.; U.S. Pat. No. 4,439,165 by Rothstein; U.S. Pat. No. 2,958,875 by McClain; U.S. Pat. No. 4,929,208 by Corica; U.S. Pat. No. 3,092,857 by Churchman; PCT Patent No. WO 84/01756 by Enners; and EPO Patent No. EP 0 273 989 A1 by Tinkler.

While these devices fulfill their respective, particular objectives and requirements, the aforementioned patents do not disclose a new aquatic body board. The inventive device includes a board with a handle upwardly extended from a top face of the board and positioned towards a front end of the board. The handle comprises a resiliently deformable material to permit resilient squeezing and bending of the handle.

In these respects, the aquatic body board according to the present invention substantially departs from the conventional concepts and designs of the prior art, and in so doing provides an apparatus primarily developed for the purpose of providing extra control when body surfing.

SUMMARY OF THE INVENTION

In view of the foregoing disadvantages inherent in the known types of aquatic body boards now present in the prior art, the present invention provides a new aquatic body board construction wherein the same can be utilized for providing extra control when body surfing.

The general purpose of the present invention, which will be described subsequently in greater detail, is to provide a new aquatic body board apparatus and method which has many of the advantages of the aquatic body boards mentioned heretofore and many novel features that result in a new aquatic body board which is not anticipated, rendered obvious, suggested, or even implied by any of the prior art aquatic body boards, either alone or in any combination thereof.

To attain this, the present invention generally comprises a board with a handle upwardly extended from a top face of the board and positioned towards a front end of the board. The handle comprises a resiliently deformable material to permit resilient squeezing and bending of the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new aquatic body board apparatus and method which has many of the advantages of the aquatic body boards mentioned heretofore and many novel features that result in a new aquatic body board which is not anticipated, rendered obvious, suggested, or even implied by any of the prior art aquatic body boards, either alone or in any combination thereof.

It is another object of the present invention to provide a new aquatic body board which may be easily and efficiently manufactured and marketed.

It is a further object of the present invention to provide a new aquatic body board which is of a durable and reliable construction.

An even further object of the present invention is to provide a new aquatic body board which is susceptible of a low cost of manufacture with regard to both materials and labor, and which accordingly is then susceptible of low prices of sale to the consuming public, thereby making such aquatic body board economically available to the buying public.

Still yet another object of the present invention is to provide a new aquatic body board which provides in the apparatuses and methods of the prior art some of the advantages thereof, while simultaneously overcoming some of the disadvantages normally associated therewith.

Still another object of the present invention is to provide a new aquatic body board for providing extra control when body surfing.

Yet another object of the present invention is to provide a new aquatic body board which includes a board with a handle upwardly extended from a top face of the board and positioned towards a front end of the board. The handle comprises a resiliently deformable material to permit resilient squeezing and bending of the handle.

Still yet another object of the present invention is to provide a new aquatic body board that has a handle for grasping thereto with the hand of a user to provide more control when riding the body board and to help keep the user on the body board during use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
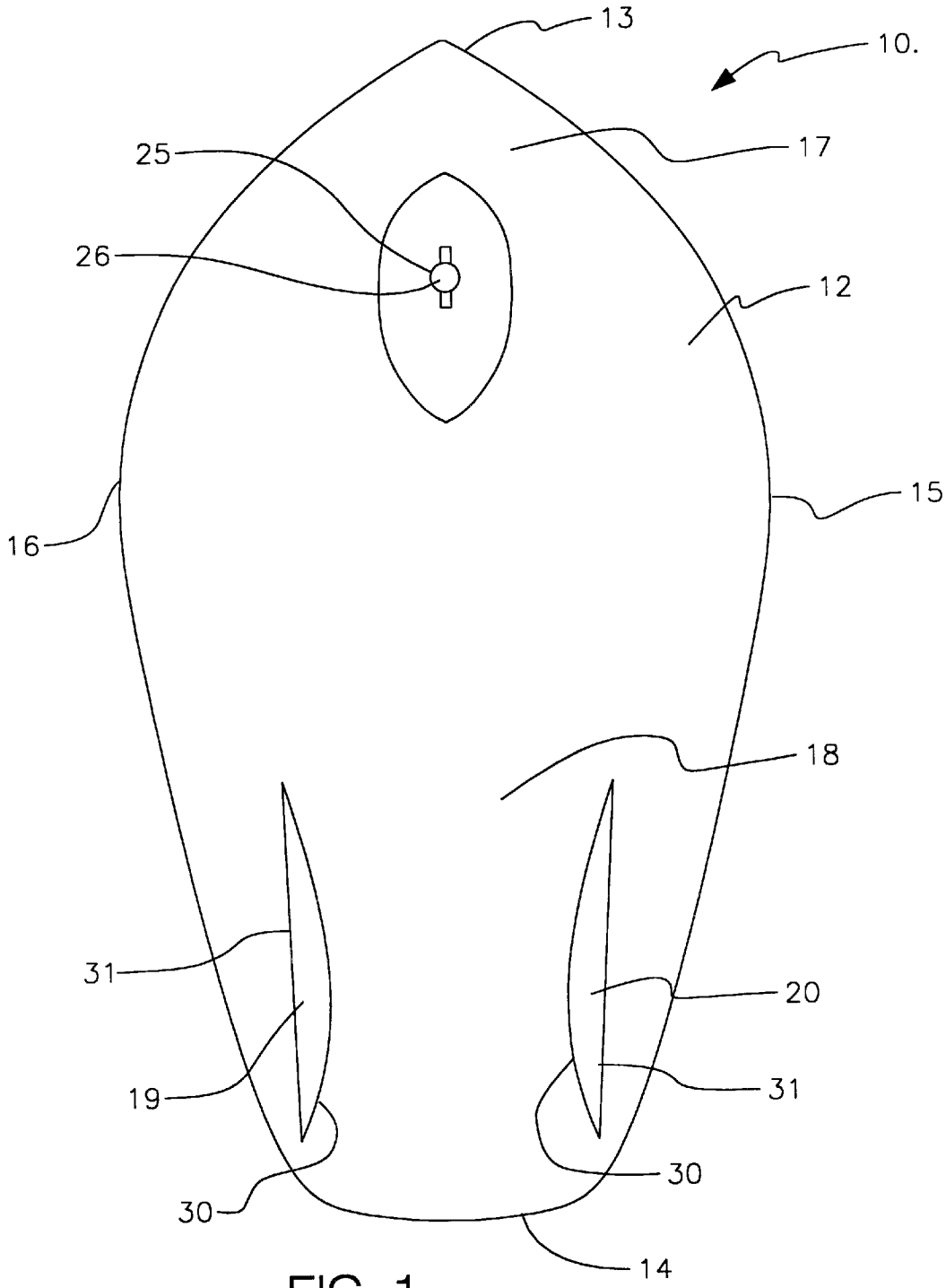
FIG. 1 is a schematic bottom view of a new aquatic body board according to the present invention.
Figure 2:
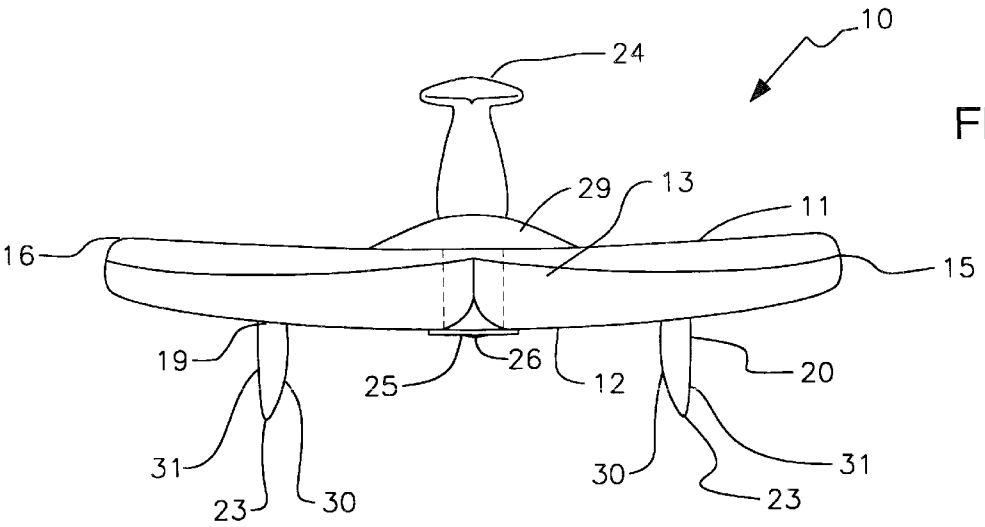
FIG. 2 is a schematic front elevational view of the present invention.
Figure 3:
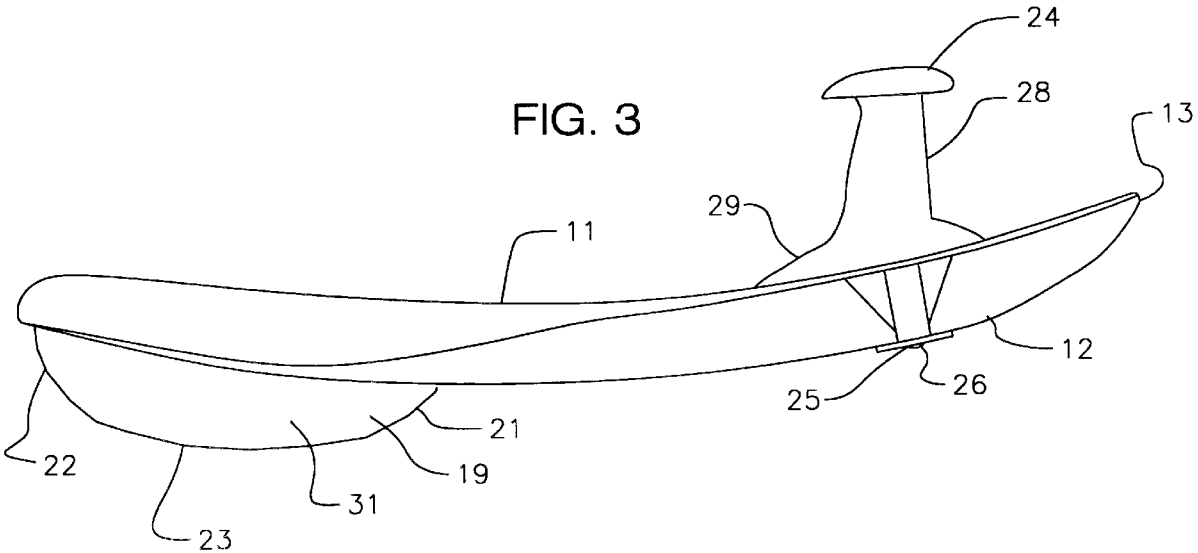
FIG. 3 is a schematic side elevational view of the present invention.

With reference now to the drawings, and in particular to FIGS. 1 through 5 thereof, a new aquatic body board embodying the principles and concepts of the present invention will be described.

As best illustrated in FIGS. 1 through 5, the aquatic body board generally comprises a board with a handle upwardly extended from a top face of the board and positioned towards a front end of the board. The handle comprises a resiliently deformable material to permit resilient squeezing and bending of the handle.

In closer detail, the aquatic body board comprises a board 10 having generally smooth top and bottom faces 11,12, arcuate front and back ends 13,14, and a pair of sides 15,16 extending between the front and back ends of the board. The board ideally comprises a foamed material or a fiberglass material or even a fiberglass covered foam material typically used for traditional prior art body boards. In use, the top face 11 of the board is designed for resting the upper torso of a user thereon when using the board to body surf.

The front and back ends of the board each are generally semi-circular in shape. The sides of the board diverge away from one another in direction from the back end of the board towards the front end of the board such that the width of the board continually tapers from the back end to the front end. This tapering of the width of the board makes the radius of curvature of the front end 13 greater than the radius of curvature of the front end 14.

Preferably, the board has an upwardly curving front portion 17 adjacent the front end of the board such that the front end of the board upwardly extends from a plane in which a remainder back portion 18 of the board lies.

Ideally, a spaced apart pair of stabilizing fins 19,20 are coupled to the bottom face of the board and located towards the back end of the board. In use, the stabilizing fins are designed for helping provide better control to the board when body surfing in water. Preferably, each of the stabilizing fins has a generally arcuate interior surface 30 and a planar exterior surface 31 with front and back edges 21,22 each extending at an obtuse angle from a generally straight bottom edge 23 of the respective stabilizing fin. Even more preferably, the obtuse angle of the front edge 21 of each stabilizing fin is greater than the obtuse angle 22 of the back edge of the respective stabilizing fin.

A handle 24 is upwardly extended from the top face of the board. The handle is positioned towards the front end of the board and located in the front region of the board. The handle is designed for grasping by one or more hands of the user when on the board to help keep the user on the board and to help guide the direction the board travels during use body surfing. The handle provides the user with the ability to apply force in specific direction to cause an associated side of the board to cut into the wave causing greater frictional resistance on the associated side thereby causing the board to turn in the direction of the associated side.

Figure 4:
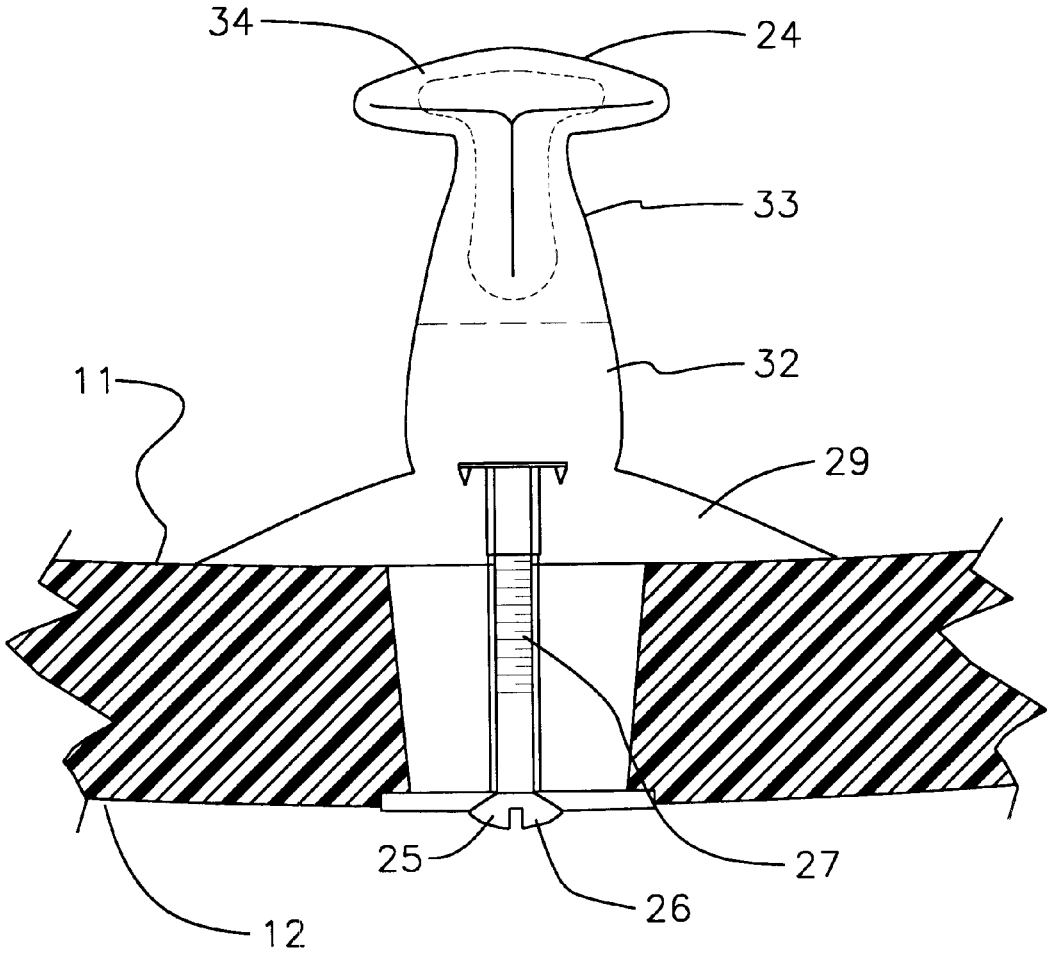
FIG. 4 is an enlarged schematic front elevational view of the handle of the present invention.
Figure 5:
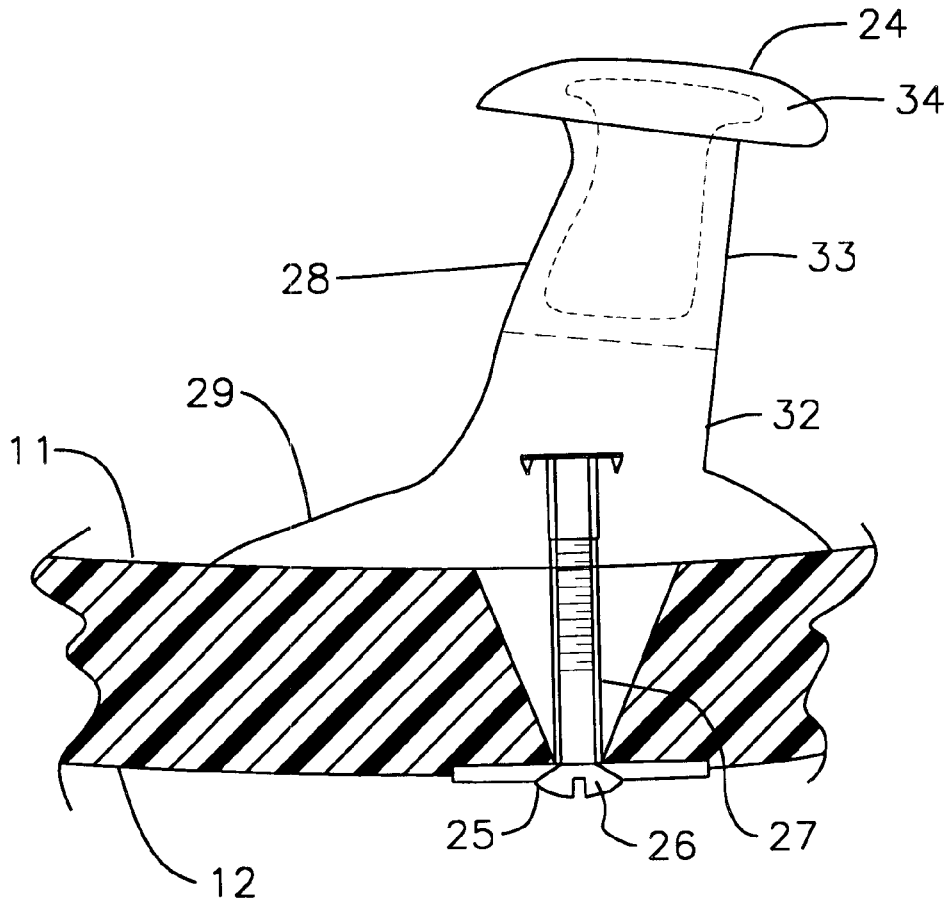
FIG. 5 is an enlarged schematic side elevational view of the handle of the present invention.

Preferably, the handle is detachably attached to the board. Ideally, a threaded fastener 25 (such as a threaded bolt) is extended through the board (preferably through a bore towards the front of the board) and into the handle to attach the handle to the board. The threaded fastener has a head portion 26 and a threaded portion 27. The head portion of the threaded fastener is positioned adjacent the bottom face of the board. With particular reference to FIGS. 4 and 5, preferably, the bore through the board has a countersink in the bottom face of the board so that the head portion of the threaded fastener generally lies flush with the bottom face of the board for safety in use by helping to prevent abrasions to a user by accidental scraping across the head portion of the threaded fastener. The threaded portion of the threaded fastener is upwardly extended from the top face of the board and threadedly inserted into the handle to attach the handle to the board as best illustrated in FIGS. 4 and 5.

The threaded fastener ideally comprises a stainless steel for safety to prevent injury to a user scraping the threaded fastener, to eliminate rust problems that arise in similar metallic fasteners during use.

The handle comprises a lower portion 32 and an upper portion 33. The lower portion comprises a preferably solid (i.e., non-hollow) resiliently deformable material such as a resiliently deformable rubber or plastic material to permit resilient bending of the handle during use. The upper portion of the handle comprises a resiliently deformable hollow material to help prevent injury to a user when the handle strikes the user, or vice versa. The resiliently deformable material also is designed for permitting a user to squeeze the handle when grasping the handle tightly to help enhance the user's grip on the handle. The upper portion of the handle also comprises an enlarged bulbous portion 34 for providing a wide surface of contact to protect a user from impact by the handle.

Preferably, the handle has a finger groove 28 forwardly facing in a direction towards the front end of the board, the finger groove is for helping enhance the user's grip on the handle during use. Even more preferably, the handle has an outwardly radiating annular flange 29 adjacent the top face of the board. The flange of the handle is designed for helping prevent a portion of the user's hand from being pinched between the handle and the top face of the board during use. The flange also provides an increased area of support for the handle when placed on the board. In an embodiment the handle can be used separately to retrofit an existing board.

In an ideal illustrative embodiment, the board has a thickness defined between the top and bottom faces of about ¾ inches and a length defined between the front and back ends of about 2 feet and a width defined between the sides of the board between about 1 foot and about 2 feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An aquatic body board, comprising:

a board having top and bottom faces, front and back ends and a pair of sides extending between said front and back ends of said board;

a spaced apart pair of stabilizing fins being coupled to said bottom face of said board, said stabilizing fins being located towards said back end of said board;

wherein said stabilizing fins each have an arcuate interior surface and a planar exterior surface and have angled front and back edges each extending at an obtuse angle from a generally straight bottom edge of the respective stabilizing fin, and wherein said obtuse angle of said front edge of each stabilizing fin is greater than said obtuse angle of said back edge of the respective stabilizing fin;

a handle being upwardly extended from said top face of said board, said handle being positioned towards said front end of said board, said handle being adapted for grasping by one or more hands of a user when on said board such that said handle facilitates the user remaining on said board and for facilitates directional guidance of said board during body surfing by the user; and said handle comprising a resiliently deformable material to permit resilient squeezing and bending of said handle.

2. The aquatic body board of claim 1, wherein said sides of said board diverge away from one another in direction from said back end of said board towards said front end of said board.

3. The aquatic body board of claim 2, wherein a radius of curvature of said back end is less than a radius of curvature of said front end.

4. The aquatic body board of claim 1, wherein said board has an upwardly curving front portion adjacent said front end of said board such that said front end of said board upwardly extends from a plane in which a remainder back portion of said board lies, said handle being located in said front portion.

5. The aquatic body board of claim 1, wherein a threaded fastener is extended through said board and into said handle to attach said handle to said board, said threaded fastener such being extended through said board in said front portion of said board.

6. The aquatic body board of claim 5, wherein said threaded fastener has a head portion and a threaded portion, wherein said head portion of said threaded fastener is positioned adjacent said bottom face of said board, said head portion of said threaded fastener lying generally flush with said bottom face of said board.

7. The aquatic body board of claim 6, wherein said threaded portion of said threaded fastener is upwardly extended from said top face of said board and threadedly inserted into said handle to attach said handle to said board.

8. The aquatic body board of claim 5, wherein said threaded fastener comprises stainless steel.

9. The aquatic body board of claim 1, wherein said handle has an outwardly radiating annular flange adjacent said top face of said board for increasing an area of support for the handle when placed on the board.

10. An aquatic body board, comprising:

a board having top and bottom faces, arcuate front and back ends and a pair sides extending between said front and back ends of said board;

said sides of said board diverging away from one another in direction from said back end of said board towards said front end of said board;

a radius of curvature of said back end being less than a radius of curvature of said front end;

said board having an upwardly curving front portion adjacent said front end of said board such that said front end of said board upwardly extends from a plane in which a remainder back portion of said board lies;

a spaced apart pair of stabilizing fins being coupled to said bottom face of said board, said stabilizing fins being located towards said back end of said board;

said stabilizing fins each having an arcuate interior surface and a planar exterior surface and having angled front and back edges each extending at an obtuse angle from a generally straight bottom edge of the respective stabilizing fin;

said obtuse angle of said front edge of each stabilizing fin being greater than said obtuse angle of said back edge of the respective stabilizing fin;

a handle being upwardly extended from said top face of said board, said handle being positioned towards said front end of said board and located in said front region of said board, said handle being adapted for grasping by one or more hands of a user when on said board such that said handle facilitates the user remaining on said board and for facilitates directional guidance of said board during body surfing by the user;

said handle being detachably attached to said board;

wherein a threaded fastener is extended through said board and into said handle to attach said handle to said board;

said threaded fastener such being extended through said board in said front portion of said board;

said threaded fastener having a head portion and a threaded portion;

said head portion of said threaded fastener being positioned adjacent said bottom face of said board said head portion of said threaded fastener lying generally flush with said bottom face of said board;

said threaded portion of said threaded fastener being upwardly extended from said top face of said board and threadedly inserted into said handle to attach said handle to said board;

said threaded fastener comprising stainless steel;

said handle comprising a resiliently deformable material;

said handle having a finger groove forwardly facing in a direction towards said front end of said board; and said handle having an outwardly radiating annular flange adjacent said top face of said board.

11. An aquatic body board, comprising:

a board having top and bottom faces, front and back ends and a pair of sides extending between said front and back ends of said board;

a handle being upwardly extended from said top face of said board, said handle being positioned towards said front end of said board, said handle being adapted for grasping by one or more hands of a user when on said board such that said handle facilitates the user remaining on said board and for facilitates directional guidance of said board during body surfing by the user; and said handle comprising a resiliently deformable material to permit resilient squeezing and bending of said handle;

a threaded fastener extending through said board and into said handle to attach said handle to said board, said threaded fastener such being extended through said board in said front portion of said board, wherein said threaded fastener comprises stainless steel; and wherein said threaded fastener has a head portion and a threaded portion, said head portion of said threaded fastener being positioned adjacent to said bottom face of said board, said head portion of said threaded fastener lying generally flush with said bottom face of said board.

12. The aquatic body board of claim 11, wherein said sides of said board diverge away from one another in direction from said back end of said board towards said front end of said board.

13. The aquatic body board of claim 12, wherein a radius of curvature of said back end is less than a radius of curvature of said front end.

14. The aquatic body board of claim 11, wherein said board has an upwardly curving front portion adjacent said front end of said board such that said front end of said board upwardly extends from a plane in which a remainder back portion of said board lies, said handle being located in said front portion.

15. The aquatic body board of claim 11, additionally comprising a spaced apart pair of stabilizing fins being coupled to said bottom face of said board, said stabilizing fins being located towards said back end of said board.

16. The aquatic body board of claim 11, wherein said threaded portion of said threaded fastener is upwardly extended from said top face of said board and threadably inserted into said handle to attach said handle to said board.

* * * * *